United States Patent [19]

Armstrong

[11] Patent Number: 4,893,751

[45] Date of Patent: Jan. 16, 1990

[54] CARBON DIOXIDE POWERED STRIPING MACHINE FOR PAINTING LONG TERM PARKING SURFACES

[76] Inventor: Carl R. Armstrong, 8386 Homer St., Detroit, Mich. 48209

[21] Appl. No.: 228,938

[22] Filed: Aug. 5, 1988

[51] Int. Cl.[4] ..... E01C 23/16

[52] U.S. Cl. ..... 239/150; 239/165; 239/172; 239/176; 118/305; 404/94; 427/137

[58] Field of Search ..... 239/172, 150, 164, 165, 239/170, 176, 159, 163; 118/305; 427/137; 404/94

[56] References Cited

U.S. PATENT DOCUMENTS

| | | | |
|---|---|---|---|
| 1,998,502 | 4/1935 | Glasgow | 239/150 |
| 1,999,563 | 4/1935 | Glasgow | 239/150 |
| 2,756,103 | 7/1956 | Creswell | 239/150 |
| 2,883,115 | 4/1959 | Converse | 239/172 |
| 3,352,283 | 11/1967 | Maus | 118/305 |
| 3,373,938 | 3/1968 | Sweet | 239/165 |
| 4,267,973 | 5/1981 | Stewart | 239/176 |
| 4,269,328 | 5/1981 | Franklyn | 239/172 |
| 4,518,121 | 5/1985 | Smith | 239/150 |
| 4,524,912 | 6/1985 | Jones | 239/150 |
| 4,624,602 | 11/1986 | Keiffer et al. | 239/172 |

*Primary Examiner*—Robert J. Oberleitner
*Assistant Examiner*—Christopher G. Trainor
*Attorney, Agent, or Firm*—Dykema Gossett

[57] ABSTRACT

A striping machine for painting parking surfaces including long-term parking surfaces comprises a frame and platform on wheels and a handle movable over a parking surface and including an upright support post adjustably supporting an upright spray head having a depending outlet. A pressurized paint pot or paint pump is mounted upon a frame and has an outlet conduit connected to the spray head. A tank of pressurized carbon dioxide is mounted upon the platform and has an outlet connected to a manifold. A first conduit connects the manifold to the spray head, a second conduit connects the manifold to the paint pot, and a third conduit connects the manifold to a three-way valve on the handle, the valve having an outlet connected to the spray head for controlling the opening of its outlet.

7 Claims, 3 Drawing Sheets

CARBON DIOXIDE POWERED STRIPING MACHINE FOR PAINTING LONG TERM PARKING SURFACES

FIELD OF INVENTION

The present invention relates to a striping machine for painting parking surfaces, and more particularly to a carbon dioxide-powered striping machine for painting parking surfaces.

BACKGROUND OF THE INVENTION

Previously, stripes have been applied to parking surfaces of asphalt or concrete by the application of movable devices which direct a spray of atomized paint onto a surface in a continuous fashion, and whereas various means are employed for pressurizing the paint as well as the paint spray apparatus. One of the known methods of pressurization is the use of an air compressor normally operated by an internal combustion engine or operated by the vehicle itself. The difficulty with the use of compressors is the noise involved, fumes of the internal combustion engine used, the complicated hydraulic or pneumatic circuits and valving, the use of oil and water extractors, and the production of toxic carbon monoxide in the operation of such compressors or the drive therefor. Another difficulty is the problem of painting between parked cars because the equipment was too wide.

SUMMARY OF THE INVENTION

An important feature of the present invention is to provide a self-contained vehicle including a framework on wheels movably mounted upon a surface to be striped which includes provision for mounting a pressurized paint pot or paint pump, a tank of pressurized carbon dioxide, multiple tubing, valves, gages and pressure regulators, together with a manual control valve easily accessible to the user for pressurizing the paint pot or paint pump connected to a spray head by a suitable conduit, for pressurizing the spray head for atomizing the paint therein and additionally pressurizing the spray head for opening the normally closed outlet thereon upon the operation of a remote-controlled, manually-operated switch or valve.

Another feature of the present invention is to provide a striping machine for painting long-term parking surfaces wherein striping may be applied thereto, even though cars are parked in the spaces provided therefor, and in the use of the present striping machine which is of such dimension as to be movably positioned between adjacently parked vehicles.

As another feature, the present striping machine includes a frame having a platform with a laterally arranged arm upon one side of the frame and extending forwardly thereof with a pair of rear wheels journaled upon the frame, with a front wheel journaled upon the arm, and with the wheels moving over a parking surface to be striped.

Another feature is to provide an upright support post upon the frame or arm which mounts a transverse support tube slidably thereon and adjustably positioned relative to the parking surface and supportably mounting a first upright spray head which has a downwardly depending, normally closed spray outlet directed toward the ground surface and wherein the dimensions of the line applied to the ground surface on moving the vehicle depends upon the vertical height of the spray head with respect to the ground surface.

As another important feature, the present striping machine includes a platform mounting a pressurized paint pot and a tank of pressurized carbon dioxide in the range of 800 to 1500 psi, together with a suitable pressure regulator for delivering to a manifold pressurized carbon dioxide of approximately 100 psi for use in pressurizing the paint pot and in pressurizing the spray head atomizing the paint therein and for opening the spray outlet.

Another important feature of the present invention includes connected to the outlet from the carbon dioxide tank a manifold pipe having a plurality of outlet connections and with a series of conduits separately extending from the manifold which respectively pressurize the spray head with carbon dioxide for atomizing the paint therein when the outlet is open, a second conduit for pressurizing the paint pot and including an outlet conduit from the paint pot to the spray head delivering pressurized paint to the interior thereof, and a third conduit interconnecting the manifold and a manually controlled valve upon the handle of the machine for regulating the flow of pressurized carbon dioxide to the spray head for opening the normally closed outlet thereof and for feeding a spray of atomized paint onto a ground surface and the formation of a line thereon upon rectilinear movement of the striping machine along such ground surface.

It is another feature to provide upon the vertically adjustable support tube a second port member for adjustably mounting a second spray head with appropriate connections thereto for applying a second pattern of spray onto the ground surface for forming a second line parallel to the first line upon rectilinear movement of the striping machine along the ground surface.

Another feature includes the adjustability of one or both spray heads laterally with respect to their support for determining the relative location of the line of spray applied to the ground surface and relative to the vehicle as required for particular job conditions.

Another important feature is the provision of an extension upon a support rod upon the mount post such that a second spray head may be arranged rearwardly of the first spray head or rearwardly of the support and adjacent the rear wheels so that upon rearward tilting of the frame for movement along merely the rear wheels and for retracting the machine along a radius, a curved line may be applied to the ground surface.

Another important feature of the present invention is to provide a complete pneumatic circuit between the spray head, a second spray head, an alternate or additional hand gun, a container of pressurized carbon dioxide, a pressurized paint pot, together with valving, pressure regulators and conduits for the operation of the present striping machine under remote manual control.

These and other features and objects will be seen from the following specification and claims in conjunction with the following drawings.

THE DRAWINGS

It will be understood that the above drawings illustrate merely preferred embodiments of the invention, and that other embodiments are contemplated within the scope of the claims hereafter set forth.

DETAILED DESCRIPTION OF AN EMBODIMENT OF THE INVENTION

Figure 1:
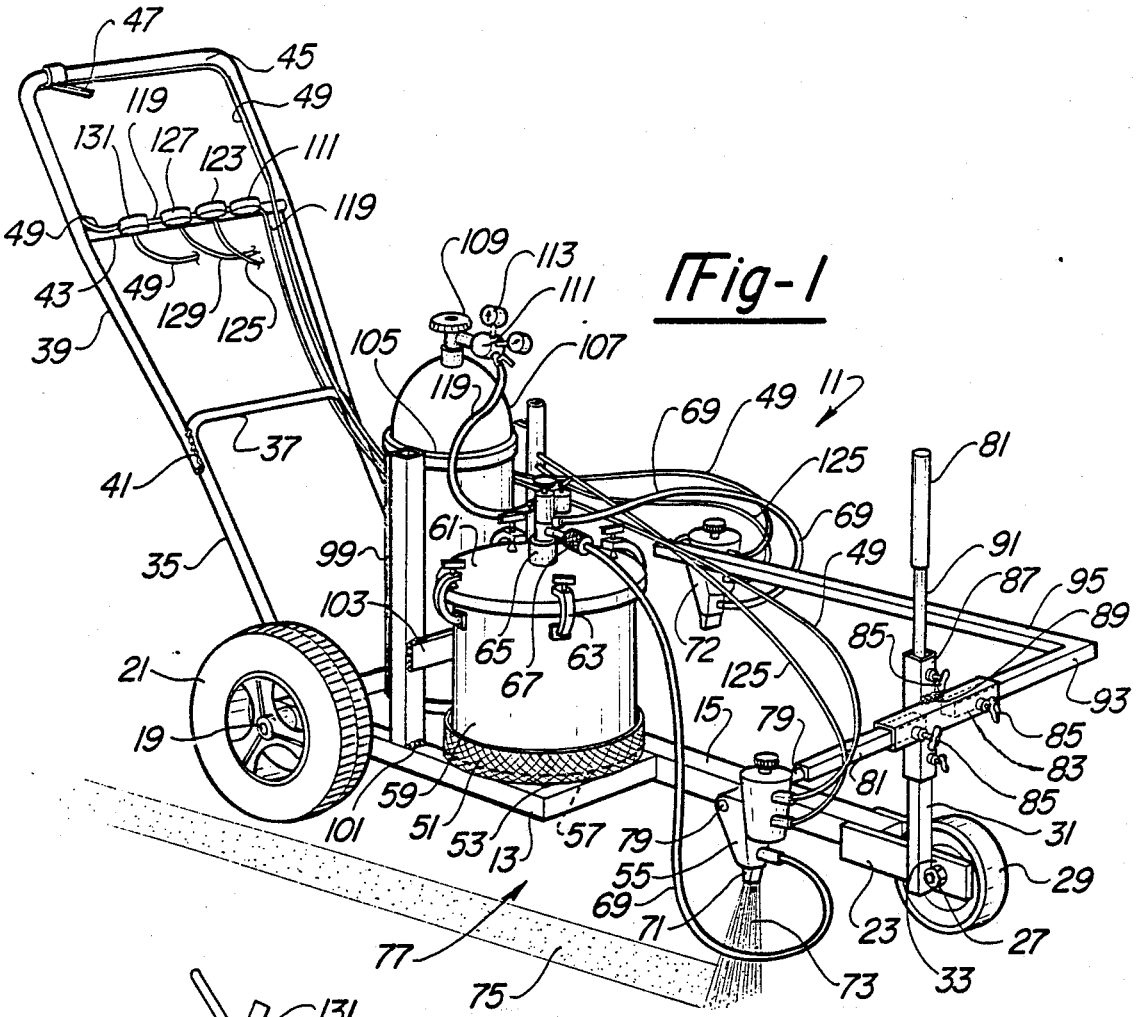
FIG. 1 is a front perspective view of the present striping machine as movably mounted upon a ground surface on which a single stripe has been painted on forward movement of the machine thereon.
Figure 2:
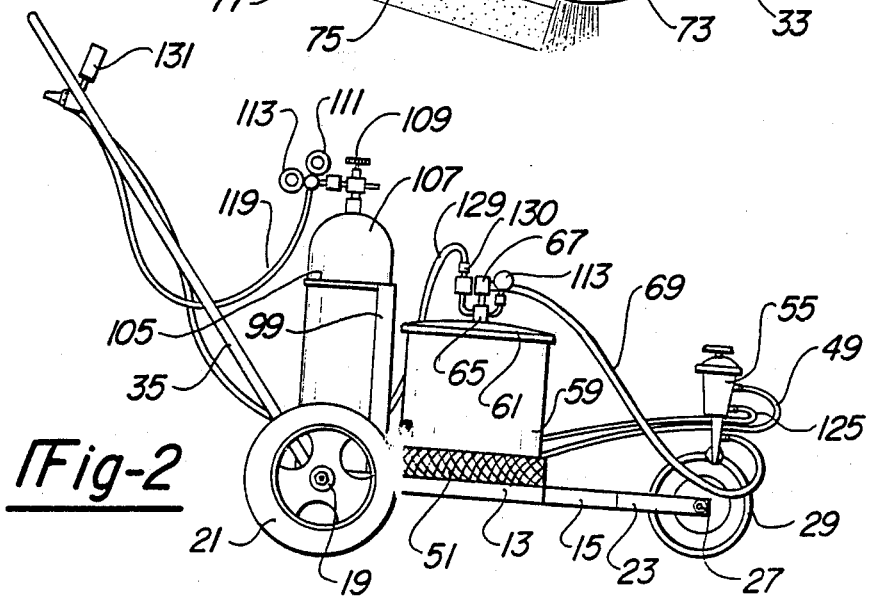
FIG. 2 is a side elevational view of the striping machine on a reduced scale.
Figure 3:
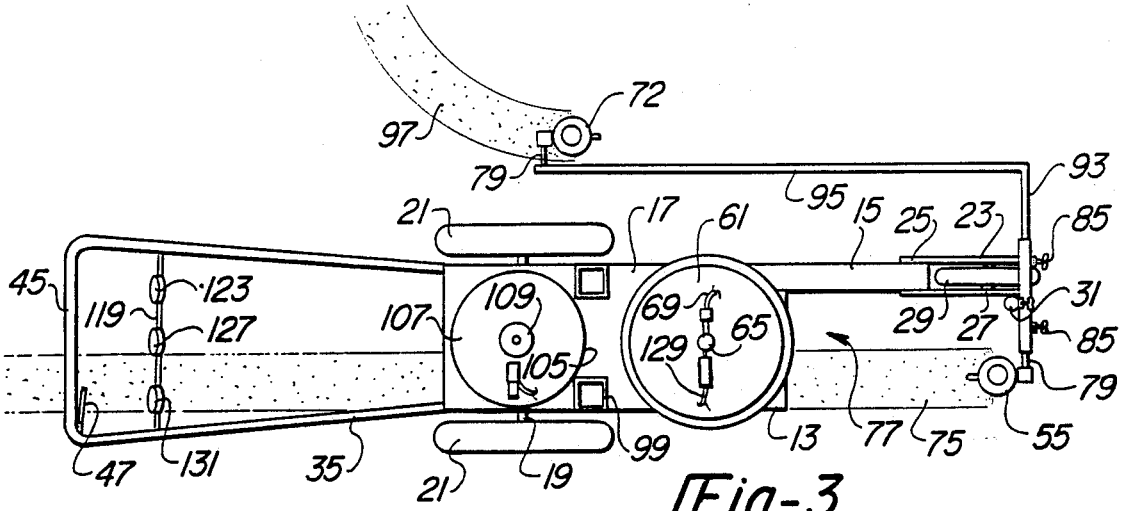
FIG. 3 is a plan view of the striping machine on a reduced scale, illustrating the adjustability of the spray head for the location of the paint strip and for the alternate use of a second spray head for forming a curved line.

Referring to the drawings, the present $CO_2$-powered striping machine for painting long-term surfaces is generally indicated at 11 in FIG. 1 and includes a generally rectangular frame 13 having a laterally arranged arm 15 upon one side thereof and extending forwardly, and with platform 17, FIG. 3, overlying said frame.

A pair of opposed aligned stud shafts 19 are secured to frame 13 rearwardly thereof, supportably mounting and journaling a pair of rear wheels 21.

A pair of spaced stirrups 23 overlie the forward end of arm 15 and are secured thereto as by the welds 25, FIG. 3, and between their forward ends support axle shaft 27 upon which is journaled front wheel 29.

Upright post 31 of square cross-section is welded to one of the stirrups 23 as at 33. Handle 35 of general U-shape at its ends is secured to the axles 19 and an adjacent part of the frame 13 and extends rearwardly and upwardly, including a first crossbar 37.

Handle 35 includes a U-shaped extension 39 welded thereto as at 41 having an intermediate crossbar 43 and a top pusher bar 45.

The manually-controlled three-way valve 47 is mounted upon pusher bar 45 for convenient access to the user of the machine for controlling the "on" and "off" condition or flow of pressurized carbon dioxide through the conduit 49 which is connected to spray head 55, FIG. 1. In the normal operation of such spray head, there is included therein an atomizer for the paint therein to which pressurized carbon dioxide through conduit 125 applied on opening the valving or other means for facilitating the flow of atomized paint through the throated outlet 71 of the spray gun 55.

It will be presumed that the outlet 71 is normally closed and remains closed even upon pressurization with paint into the spray gun until the hand valve 47 has been manually operated to open the conduit 49 for flow of pressurized carbon dioxide through conduit 49 and into the upper end of the spray head 55. This results in opening the outlet 71.

A second spray gun is shown at 72 to which a secondary branch of the conduit 49 is connected, as shown in FIG. 1, if and when the second spray gun is to be employed alone or simultaneously with the use of the spray gun. Normally speaking, with the second spray gun 72 located in the rearward position for forming the curved line 97, then in that the case, during the formation of such curve, the connections to the spray gun 55 are closed and shut off. However, when the second spray gun is mounted upon the support 83 as in FIG. 4, at the forward end of the striping machine for imprinting or spraying a pair of parallel spaced lines upon the ground surface 77, then in that case, both of the conduits 49 to the respective spray guns are simultaneously energized for opening the respective outlets 71 thereof.

Mounted upon platform 17 is a circular retainer 51 which has an internal annular flange 57, welded to the platform as at 53 with the internal flange supportably engaging the pressurized paint pot 59, FIG. 1.

Figure 8:
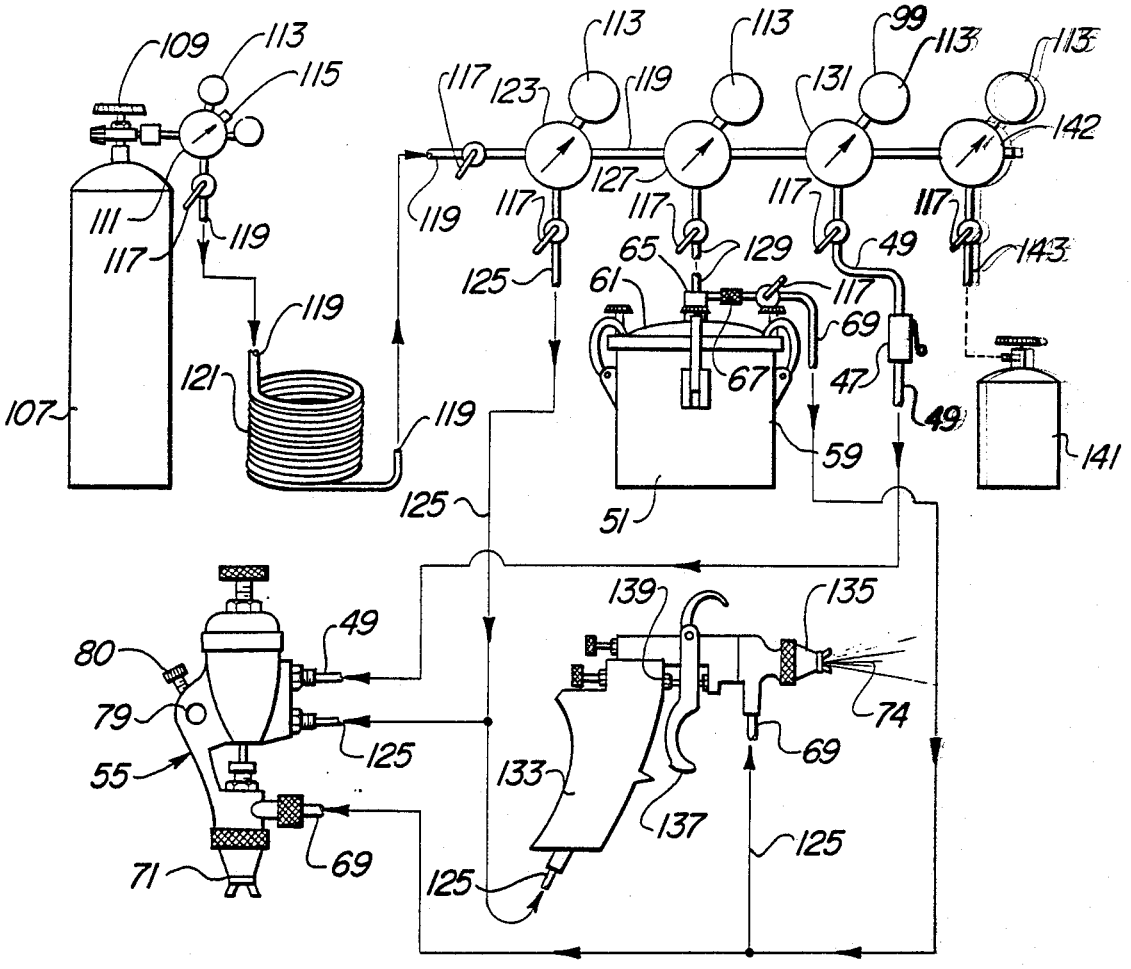
FIG. 8 is a schematic diagram of the complete pneumatic circuit for the striping machine including the pressurized tank of carbon dioxide and the pressurized paint pot, a spray head, a hand gun and the connections therefor.

Removably positioned over said paint pot is the cover 61 held down by a plurality of conventional pivot clamps 63, with the cover including an outlet 65, FIGS. 1 and 8, and a conventional filter 67 and connected thereto a conduit 69 for delivering pressurized paint to the interior of the spray heads 55 and/or 72 when the respective spray head is operational.

The respective spray heads include a depending throated outlet 71 for providing a spray pattern 73 such as shown in FIG. 1, for forming the line 75 on rectilinear movement of the striping machine along the parking surface 77.

In view of the capability of vertically adjusting the spray head 55 and/or spray head 72 relative to the ground surface, the width of the painted stripe 75 may be regulated with respect to the parking surface 77.

The mounting of the spray head 55 includes a laterally extending shaft 79 which at one end adjustably extends into the body of the spray head 55 and is secured by a suitable set screw 80, FIG. 8. Shaft 79 towards its other end includes a square shaft 81 which is adjustably positioned for lateral adjustment within the square tube 83 and secured therein by the set screw 85, FIG. 1.

The tube 83, sometimes referred to as the transverse support tube, is slidably and adjustably mounted upon support post 31. For this purpose, the transverse support tube 83 is secured to the upright square tube 87 as by the welds 89. Tube 87 is adjustably positioned upon post 31 and secured thereto by the bottom set screw 85, FIG. 1.

Positioned within the upper end of the upright square tube 87 is an auxiliary spray head support rod 91 with a square extension 81 thereon normally retained in a non-use position by the upper set screw 85. In use, auxiliary rod 81 is removed by loosening the set screw 85 and reassembled with respect to the opposite end of transverse support tube 83, such as shown in FIGS. 4 and 6.

Figure 6:
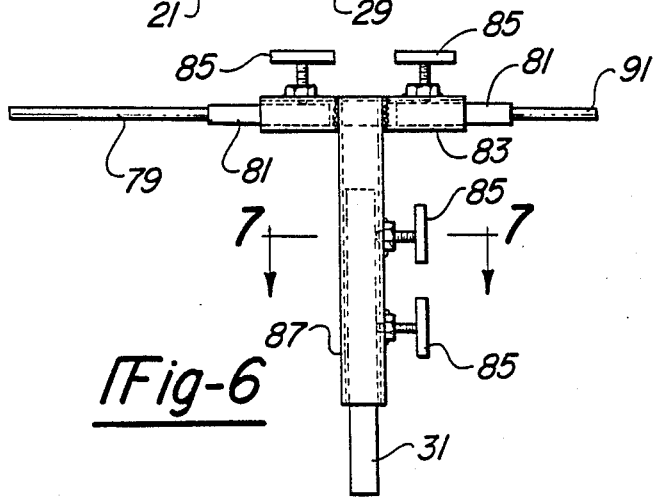
FIG. 6 is a fragmentary front elevational view, on an enlarged scale, showing the use of the support tube for mounting a pair of spray heads such as shown in FIG. 4 and on an increased scale.
Figure 7:
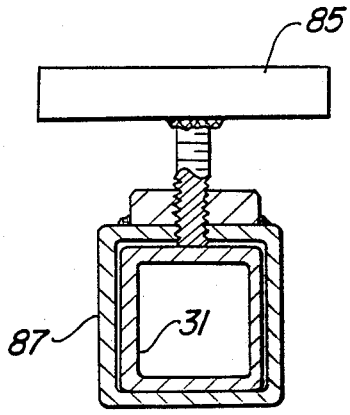
FIG. 7 is a fragmentary section taken in the direction of arrows 7-7 of FIG. 6.

The square end 81 of the auxiliary support rod 91 is projected into the tube 83 and secured thereto by the set screw 85, such as shown in FIG. 6. It is noted that the corresponding set screws 85 in FIG. 6, for convenience of illustration, have been rotated 90 degrees from what is shown in FIG. 1. The function is the same, however, namely to removably anchor or adjustably secure the corresponding square rods 81 for supporting the respective spray heads 55 and 72 and for arranging their location with respect to each other and their lateral adjustment with respect to the support tube 83. Again, the set screws 85 for controlling the vertical adjustment tube 87 are shown in a 90 degree related position in FIG. 6, with both set screws engaging the support post 31, if the upright tube 87 has been lowered sufficiently.

Figure 4:
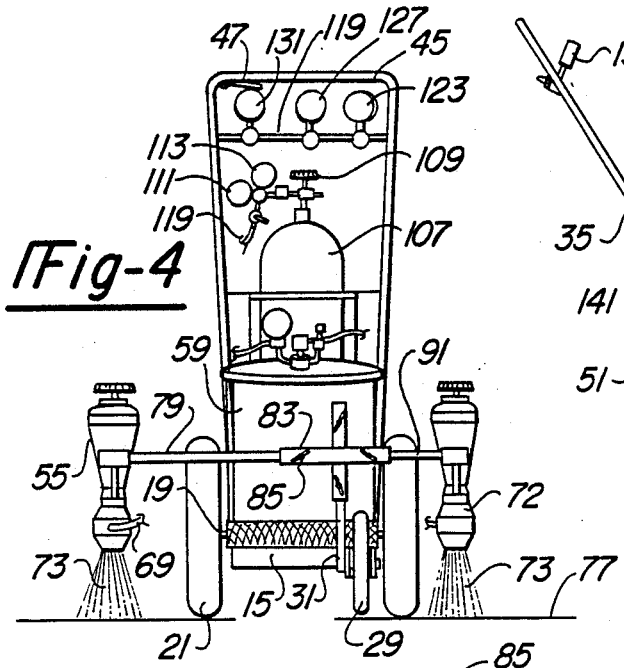
FIG. 4 is a front elevational view of the striping machine with a pair of spray heads in use for applying two parallel painted lines upon a ground surface.

Instead of the use of the second spray head 72 upon the outer end of the secondary support 81, FIGS. 4 and 6, the secondary spray head may be employed such as shown in FIGS. 1 and 3. Here, the secondary square shaft 93 of L-shape at one end is projected into the outer end of the support tube 83 and secured thereto by set screw 85. Auxiliary square shaft 93 terminates in the right angularly-related rearward extension 95 which extends at its end to adjacent the axle 19 of the rear wheels 21 and includes the out-turned support rod 79 for the secondary spray head 72.

In the mounting of the respective spray heads 55 and 72 upon the corresponding support rods 79, normally the spray head is generally upright but is inclined forwardly at an acute angle up to five degrees, for illustration, so that upon forward movement of the spray head applying the pressurized spray 73, the ground surface directly ahead of the paint line has the dirt and dust thereon blown away by the pressure of the carbon dioxide which escapes during the spraying.

The secondary spray head 72 is used independently of the first-described spray head 55 which is shut off by suitable hand valves, and wherein with the secondary spray head 72 pressurized by the conduits 49 and 125 and supplied with pressurized paint through the conduit 69, upon opening of the line 49 through the hand valve 47 and rearward retraction of the striping machine upon a radius relative to the rear wheels 21, and with the vehicle tilted upwardly at its forward end so only the rear wheels are on the ground surface, a curved painted line 97 is applied as shown in FIG. 3.

Mounted upon the frame 13 intermediate its ends are a pair of upright posts 99 welded thereto as at 101 and including a reinforcement crossbar 103 interconnecting the posts. Adjacent the upper end of said posts is arranged a horizontally disposed hoop 105 secured to the posts as by welding. The pressurized carbon dioxide tank 107 is projected through hoop 105 and is supported upon platform 17, FIG. 1, to remain in an upright position during its use and during movements of the striping machine along the parking surface 77.

The tank of pressurized carbon dioxide is pressurized preferably at approximately 800 psi but can be in a range of 800 to 1500 psi. Said tank includes an on-off hand valve 109 at the top thereof. Connected thereto is a pressure regulator 111 with visible gage 113 for reducing the pressure for normal use to 100 psi approximately, though this may be varied depending upon conditions. The present pressure regulator has connected thereto a safety pop-off valve 115, FIG. 8, which opens at approximately 120 psi to thereby assure that the outlet conduit 119 from the pressure regulator 111, sometimes referred to as a manifold pipe, maintains pressurized carbon dioxide at 100 psi approximately. Conventional on-off hand control valves 117 are shown throughout in FIG. 8 as a means for disconnecting a particular adjacent conduit against the flow of fluids therethrough.

Referring to FIG. 8, the outlet or manifold pipe 119 at one portion thereof is surrounded by a gas heater coil 121 heating up the pressurized carbon dioxide passing through the manifold pipe.

Manifold pipe 119 as shown in FIG. 8 has a series of outlet connections thereto to which are applied the respective adjustable pressure regulators 123, 127, 131 and 142 respectively with their associated visible gages 113.

A first conduit 125 extends from pressure regulator 123 which has been preset for 42 psi, approximately, under the control of a hand valve 117 and adapted for feeding pressurized carbon dioxide through the identified conduits 125 to the respective spray heads 55 and 72, assuming both are connected for operation.

Arranged upon the interior of the respective spray heads is an atomizing device by which the pressurized carbon dioxide passing through the conduit 125 thereto on the interior of the spray heads 55, for illustration, atomizes the pressurized paint therein for providing the spray 73 when the hand valve 47 has been activated to an "on" position initiating the flow of pressurized carbon dioxide through the control conduit 49.

As further shown in the schematic diagram, FIG. 8, second conduit 129 joins a second outlet connection upon the manifold pipe 119 with an adjustable pressure regulator 127 interposed and a hand valve at 117 and wherein the pressure regulator in the illustrative embodiment is set at 40 pounds psi, approximately.

Conduit 129, as schematically shown, is connected to a fitting including a quick disconnect upon the cover 61 of the paint pot 59 pressurizing the interior of said paint pot. This, in turn, pressurizes the respective conduits 69, of which a pair are shown in FIG. 1, for delivering pressurized paint to the interiors of the respective spray heads 55 and 72 for flow therethrough when the outlet 71 has been opened. The flow therefrom, of course, is in the form of an atomized spray at 73 due to application of pressurized carbon dioxide through the respective conduits 125.

A third conduit 49, being a main control conduit, is joined with a third outlet connection on the manifold pipe 119 which includes a pressure regulator 131 with associated gage 113 and hand valve 117 and wherein the pressure regulator is set for delivery in the range of 20 to 80 psi as needed for a particular job environment and conditions. The conduit 49, fragmentarily shown in FIG. 8, extends to the three-way valve 47 upon the top bar 45 of the handle 35–39 of the striping machine, and in the condition of the three-way valve shown in FIG. 8, which is normally closed, preventing any flow of pressurized carbon dioxide therethrough.

The conduit 49 continues from the three-way valve and through the branch conduits 49, FIG. 1, to the upper ends of the respective spray heads 55 and/or 72 to control opening of the throated outlet 71. Under that condition and with the handle 41 depressed to an open position, the respective spray head 55 has been activated with the pressurized carbon dioxide through conduit 49 causing opening of the outlet 71 and with the pressurized conduit 125 providing a flow of pressurized carbon dioxide for atomizing paint delivered to the interior of the spray head as through the conduit 69 to provide the spray 73 and accordingly the painted line 75 as the striping machine is moved in a rectilinear path along the parking surface 77, such as shown in FIG. 1.

As is further shown schematically in FIG. 8, the conduit 49 connects a corresponding fitting to the spray head 55 for opening the corresponding outlet 71, and the conduit 125 provides pressurized carbon dioxide to the interior of the spray head for atomizing the paint delivered thereto through the conduit 69 fragmentarily shown in FIG. 8.

Forming a part of the circuit, FIG. 8, and normally employed in conjunction with the use of the striping machine 11 of FIG. 1, is a hand spray gun 133 which is normally suspended over some portion of the handle 39 and includes the nozzle 135, normally closed, and the spring-biased normally positioned trigger 137 adapted to open an internal control valve 139 for initiating the flow of carbon dioxide gas under pressure to the nozzle 135. The branch of the carbon dioxide pressurized conduit 125 shown in the upper portion of FIG. 8. Carbon dioxide gas at about 42 psi is further delivered to the hand gun as at 125, FIG. 8, so that upon manual application of the trigger 137 and with paint supplied to the interior of the hand gun at 69, there will be a spray through the orifice 135 such as shown at 74 for application to a stencil or the like for applying indicia to the parking surface 77.

Figure 5:
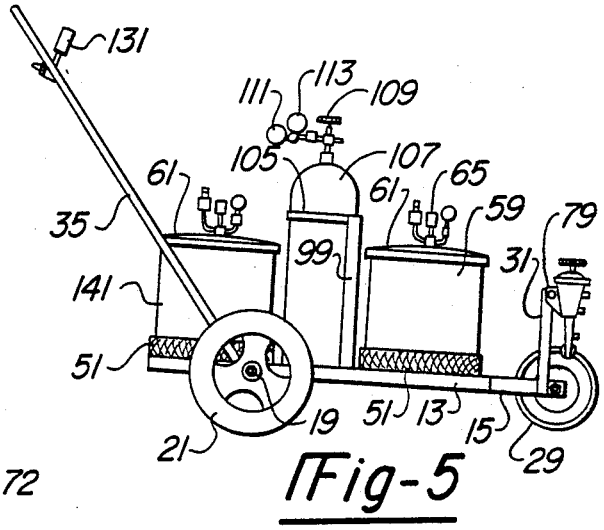
FIG. 5 is a side elevational view of a modified striping machine which mounts a second pressurized paint pot.

As shown in FIG. 5, there is provided a second paint pot 141 with similar cover 61, schematically shown in FIG. 8. To a fourth connection upon the manifold pipe 119 there is connected an adjustable pressure regulator 142 with associated gage 113 and hand valve for delivering through the conduit 143 pressurized carbon dioxide into the second paint pot 141. The paint pot 141 may be used for paint of a different color, such as black, white, yellow, or blue. alternately, the pressurized pot 141 may store glass beads, with suitable connections for a corresponding spray head so that glass beads can be applied to the spray line 75 for rendering it more reflective at night.

FIG. 8 schematically illustrates the connections for pressurizing through conduit 143 the secondary paint pot 141 which may be a container for glass beads or paint of a different color.

Should an additional spray head be provided of a special construction for the application of the glass beads, then the same connections for delivery of the glass beads thereto and for the other controls are the same as above described with respect to spray head 55.

It is contemplated that the typical $CO_2$ pressure tank 107 could be replaced by a typical paint pump with a container to be operated by pressurized carbon dioxide or, alternately, an airless paint pump with a container, driving the motor with pressurized carbon dioxide and wherein "airless" refers to the omission of the use of an atomizer not needed. Both such alternate paint pumps are available on the market and are sold by Binx Manufacturing Company of Franklin Park, Ill. Thus, under some conditions, pressurization of the respective spray heads would be by the use of paint pumps.

In the use of the term "paint pot," it is regarded as equivalent that a paint pump may be used.

Figure 9:
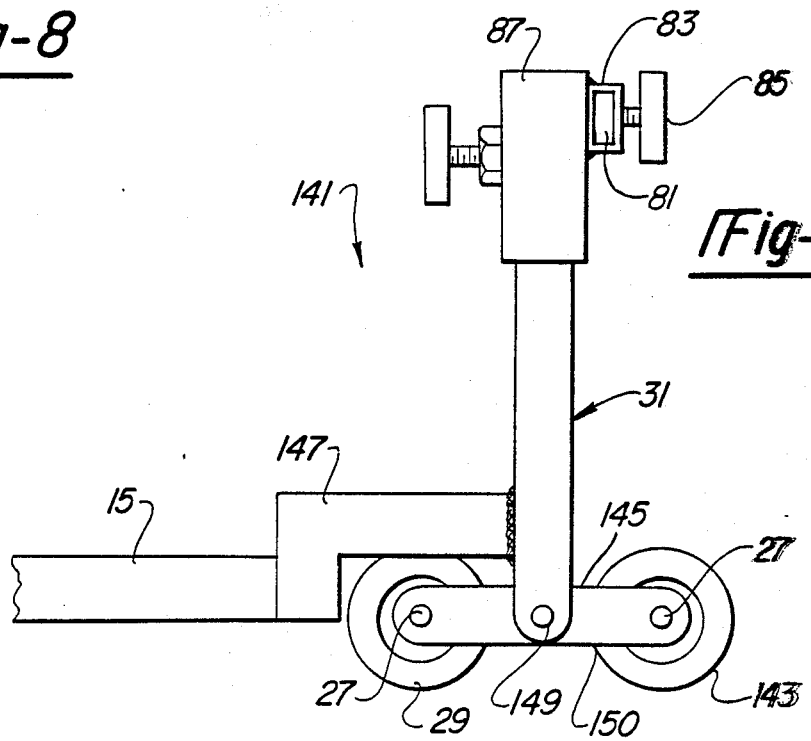
FIG. 9 is a fragmentary side elevational view of a modified front wheel mounting.

A modified front wheel mounting 141, FIG. 9, includes a pair of spaced front wheels 29 and 143. These are journaled at 27 at opposite ends of the pair of stirrups 145.

Vertically offset arm extension 147 is welded to the forward end of arm 15. Post 31, also shown in FIG. 1, intermediate its ends is secured to extension 147 and at its lower end is pivotally connected to one of the stirrups at 149. By this construction, any rise or depression in the surface engaged by wheel 143 raises or lowers the frame to a lesser extent so as not to seriously affect the width of the painted line 75.

Having described my invention, reference should now be had to the following claims.

I claim:

1. A striping machine for painting parking surfaces including long-term parking surfaces comprising:

a frame having a platform;

a laterally arranged arm upon one side of the frame and extending forwardly thereof;

a pair of rear wheels journaled upon the frame;

a front wheel journaled upon one end of said arm;

said wheels being movable over the parking surface to be striped;

an upright support post secured to said arm;

a transverse support tube slidably and adjustably mounted upon said post relative to the parking surface;

a first upright spray head mounted upon said support tube and having a depending normally closed spray outlet directed toward said surface;

a pressurized paint pot storing paint mounted upon said platform and having an outlet conduit connected to said spray head;

a rearwardly and upwardly inclined U-shaped handle connected to said frame;

a tank of carbon dioxide pressurized in the range of 800 to 1500 psi, mounted and anchored upon said platform and having an outlet;

a manifold pipe connected to said tank outlet and having a plurality of outlet connections;

a first conduit interconnecting a first one of said outlet connections and said first spray head for pressurizing said spray head with carbon dioxide;

a second conduit interconnecting a second one of said outlet connections on said manifold and said paint pot to pressurize the interior thereof;

a three-way manual control valve mounted upon said handle;

a third conduit interconnecting a third one of said outlet connections on said manifold with said control valve;

said third conduit extending from said control valve and connected to said spray head for controlling opening of the spray outlet;

with said spray outlet adapted for directing a spray of atomized paint onto said parking surface and forming a line thereon as the frame is moved in a rectilinear path along said surface; and said spray head being inclined forwardly at an acute angle up to 5 degrees for blowing away loose dirt and dust upon the parking surface as the frame is advanced thereon.

2. A striping machine for painting parking surfaces including long-term parking surfaces comprising:

a frame having a platform;

a laterally arranged arm upon one side of the frame and extending forwardly thereof;

a pair of rear wheels journaled upon the frame;

a front wheel journaled upon one end of said arm;

said wheels being movable over the parking surface to be striped;

an upright support post secured to said arm;

a transverse support tube slidably and adjustably mounted upon said post relative to the parking surface;

a first upright spray head mounted upon said support tube and having a depending normally closed spray outlet directed toward said surface;

a pressurized paint pot storing paint mounted upon said platform and having an outlet conduit connected to said spray head;

a rearwardly and upwardly inclined U-shaped handle connected to said frame;

a tank of carbon dioxide pressurized in the range of 800 to 1500 psi, mounted and anchored upon said platform and having an outlet;

a manifold pipe connected to said tank outlet and having a plurality of outlet connections;

a first conduit interconnecting a first one of said outlet connections and said first spray head for pressurizing said spray head with carbon dioxide;

a second conduit interconnecting a second one of said outlet connections on said manifold and said paint pot to pressurize the interior thereof;

a three-way manual control valve mounted upon said handle;

a third conduit interconnecting a third one of said outlet connections on said manifold with said control valve;

said third conduit extending from said control valve and connected to said spray head for controlling opening of the spray outlet;

with said spray outlet adapted for directing a spray of atomized paint onto said parking surface and forming a line thereon as the frame is moved in a rectilinear path along said surface; and a first adjustable pressure regulator connected to said carbon dioxide outlet for pressurizing carbon dioxide to said manifold at about 100 psi.

3. A striping machine for painting parking surfaces including long-term parking surfaces comprising:

a frame having a platform;

a laterally arranged arm upon one side of the frame and extending forwardly thereof;

a pair of rear wheels journaled upon the frame;

a front wheel journaled upon one end of said arm;

said wheels being movable over the parking surface to be striped;

an upright support post secured to said arm;

a transverse support tube slidably and adjustably mounted upon said post relative to the parking surface;

a first upright spray head mounted upon said support tube and having a depending normally closed spray outlet directed toward said surface;

a pressurized paint pot storing paint mounted upon said platform and having an outlet conduit connected to said spray head;

a rearwardly and upwardly inclined U-shaped handle connected to said frame;

a tank of carbon dioxide pressurized in the range of 800 to 1500 psi, mounted and anchored upon said platform and having an outlet;

a manifold pipe connected to said tank outlet and having a plurality of outlet connections;

a first conduit interconencting a first one of said outlet connections and said first spray head for pressurizing said spray head with carbon dioxide;

a second conduit interconnecting a second one of said outlet connections on said manifold and said paint pot to pressurize the interior thereof;

a three-way manual control valve mounted upon said handle;

a third conduit interconnecting a third one of said outlet connections on said manifold with said control valve;

said third conduit extending from said control valve and connected to said spray head for controlling opening of the spray outlet;

with said spray outlet adapted for directing a spray of atomized paint onto said parking surface and forming a line thereon as the frame is moved in a rectilinear path along said surface; and a gas heater coil surrounding a part of said manifold pipe for heating carbon dioxide passing therethrough.

4. A striping machine for painting parking surfaces including long-term parking surfaces comprising:

a frame having a platform;

a laterally arranged arm upon one side of the frame and extending forwardly thereof;

a pair of rear wheels journaled upon the frame;

a front wheel journaled upon one end of said arm;

said wheels being movable over the parking surface to be striped;

an upright support post secured to said arm;

a transverse support tube slidably and adjustably mounted upon said post relative to the parking surface;

a first upright spray head mounted upon said support tube and having a depending normally closed spray outlet directed toward said surface;

a pressurized paint pot storing paint mounted upon said platform and having an outlet conduit connected to said spray head;

a rearwardly and upwardly inclined U-shaped handle connected to said frame;

a tank of carbon dioxide pressurized in the range of 800 to 1500 psi, mounted and anchored upon said platform and having an outlet;

a manifold pipe connected to said tank outlet and having a plurality of outlet connections;

a first conduit interconnecting a first one of said outlet connections and said first spray head for pressurizing said spray head with carbon dioxide;

a second conduit interconnecting a second one of said outlet connections on said manifold and said paint pot to presurize the interior thereof;

a three-way manual control valve mounted upon said handle;

a third conduit interconnecting a third one of said outlet connections on said manifold with said control valve;

said third conduit extending from said control valve and connected to said spray head for controlling opening of the spray outlet;

with said spray outlet adapted for directing a spray of atomized paint onto said parking surface and forming a line thereon as the frame is moved in a rectilinear path along said surface; and the connection of said first conduit to said manifold pipe including a second adjustable pressure regulator adjusting the pressure of carbon dioxide in said conduit to about 42 psi.

5. A striping machine for painting parking surfaces including long-term parking surfaces comprising:

a frame having a platform;

a laterally arranged arm upon one side of the frame and extending forwardly thereof;

a pair of rear wheels journaled upon the frame;

a front wheel journaled upon one end of said arm;

said wheels being movable over the parking surface to be striped;

an upright support post secured to said arm;

a transverse support tube slidably and adjustably mounted upon said post relative to the parking surface;

a first upright spray head mounted upon said support tube and having a depending normally closed spray outlet directed toward said surface;

a pressurized paint pot storing paint mounted upon said platform and having an outlet conduit connected to said spray head;

a rearwardly and upwardly inclined U-shaped handle connected to said frame;

a tank of carbon dioxide pressurized in the range of 800 to 1500 psi, mounted and anchored upon said platform and having an outlet;

a manifold pipe connected to said tank outlet and having a plurality of outlet connections;

a first conduit interconnecting a first one of said outlet connections and said first spray head for pressurizing said spray head with carbon dioxide;

a second conduit interconnecting a second one of said outlet connections on said manifold and said paint pot to pressurize the interior thereof;

a three-way manual control valve mounted upon said handle;

a third conduit interconnecting a third one of said outlet connections on said manifold with said control valve;

said third conduit extending from said control valve and connected to said spray head for controlling opening of the spray outlet;

with said spray outlet adapted for directing a spray of atomized paint onto said parking surface and forming a line thereon as the frame is moved in a rectilinear path along said surface; and the connection of said second conduit to said manifold pipe including a third adjustable pressure regulator adjusted to a pressure in said second conduit of about 40 psi.

6. A striping machine for painting parking surfaces including long-term parking surfaces comprising:

a frame having a platform;

a laterally arranged arm upon one side of the frame and extending forwardly thereof;

a pair of rear wheels journaled upon the frame;

a front wheel journaled upon one end of said arm;

said wheels being movable over the parking surface to be striped;

an upright support post secured to said arm;

a transverse support tube slidably and adjustably mounted upon said post relative to the parking surface;

a first upright spray head mounted upon said support tube and having a depending normally closed spray outlet directed toward said surface;

a pressurized paint pot storing paint mounted upon said platform and having an outlet conduit connected to said spray head;

a rearwardly and upwardly inclined U-shaped handle connected to said frame;

a tank of carbon dioxide pressurized in the range of 800 to 1500 psi, mounted and anchored upon said platform and having an outlet;

a manifold pipe connected to said tank outlet and having a plurality of outlet connections;

a first conduit interconnecting a first one of said outlet connections and said first spray head for pressurizing said spray head with carbon dioxide;

a second conduit interconnecting a second one of said outlet connections on said manifold and said paint pot to presurize the interior thereof;

a three-way manual control valve mounted upon said handle;

a third conduit interconnecting a third one of said outlet connections on said manifold with said control valve;

said third conduit extending from said control valve and connected to said spray head for controlling opening of the spray outlet;

with said spray outlet adapted for directing a spray of atomized paint onto said parking surface and forming a line thereon as the frame is moved in a rectilinear path along said surface; and the connection of said third conduit to said manifold pipe including a fourth pressure regulator adjusted to a pressure in the range of 20 to 80 psi.

7. A striping machine for painting parking surfaces including long-term parking surfaces comprising:

a frame having a platform;

a laterally arranged arm upon one side of the frame and extending forwardly thereof;

a pair of rear wheels journaled upon the frame;

a front wheel journaled upon one end of said arm;

said wheels being movable over the parking surface to be striped;

an upright support post secured to said arm;

a transverse support tube slidably and adjustably mounted upon said post relative to the parking surface;

a first upright spray head mounted upon said support tube and having a depending normally closed spray outlet directed toward said surface;

a pressurized paint pot storing paint mounted upon said platform and having an outlet conduit connected to said spray head;

a rearwardly and upwardly inclined U-shaped handle connected to said frame;

a tank of carbon dioxide pressurized in the range of 800 to 1500 psi, mounted and anchored upon said platform and having an outlet;

a manifold pipe connected to said tank outlet and having a plurality of outlet connections;

a first conduit interconnecting a first one of said outlet connections and said first spray head for pressurizing said spray head with carbon dioxide;

a second conduit interconnecting a second one of said outlet connections on said manifold and said paint pot to pressurize the interior thereof;

a three-way manual control valve mounted upon said handle;

a third conduit interconnecting a third one of said outlet connections on said manifold with said control valve;

said third conduit extending from said control valve and connected to said spray head for controlling opening of the spray outlet;

with said spray outlet adapted for directing a spray of atomized paint onto said parking surface and forming a line thereon as the frame is moved in a rectilinear path along said surface; and a second pot containing a different color paint or quantity of glass beads mounted upon said platform; and a fourth conduit interconnecting a fourth one of said outlet connections of said manifold with said second pot for pressurizing said second pot with pressurized carbon dioxide;

the connection of said fourth conduit to said manifold pipe including a fifth adjustable pressure regulator for adjusting the pressurized carbon dioxide in said fourth conduit to about 40 psi.

* * * * *